US007040742B2

(12) United States Patent
Tobinai et al.

(10) Patent No.: US 7,040,742 B2
(45) Date of Patent: May 9, 2006

(54) INK FLOW CONTROL DEVICE FOR INK JET TYPE PRINTER

(75) Inventors: Teruhiko Tobinai, Sendai (JP); Kazuhito Fujisawa, Natori (JP)

(73) Assignee: Walbro Engine Management, L.L.C., Tucson, AZ (US)

( * ) Notice: Subject to any disclaimer, the term of this patent is extended or adjusted under 35 U.S.C. 154(b) by 230 days.

(21) Appl. No.: 10/800,002

(22) Filed: Mar. 12, 2004

(65) Prior Publication Data

US 2004/0183872 A1 Sep. 23, 2004

(30) Foreign Application Priority Data

Mar. 17, 2003 (JP) ..... 2003-071930

(51) Int. Cl.
*B41J 2/175* (2006.01)

(52) U.S. Cl. ..... 347/85; 347/87

(58) Field of Classification Search ..... 347/7, 347/85, 86, 87; 137/2, 87.04, 118.06; 141/25, 141/325

See application file for complete search history.

(56) References Cited

U.S. PATENT DOCUMENTS 4,551,076 A * 11/1985 DuBois ..... 417/395
5,736,992 A * 4/1998 Pawlowski, Jr. ..... 347/7
6,170,937 B1 * 1/2001 Childers et al. ..... 347/85
6,244,698 B1 * 6/2001 Chino et al. ..... 347/94
6,390,611 B1 * 5/2002 Kobayashi et al. ..... 347/84
6,705,712 B1 * 3/2004 Usui et al. ..... 347/86
6,837,575 B1 * 1/2005 Usui ..... 347/85
6,854,836 B1 * 2/2005 Ishinaga et al. ..... 347/85

FOREIGN PATENT DOCUMENTS

JP 5201015 8/1993
JP 2002036583 2/2002
JP 2002337362 11/2002

* cited by examiner

*Primary Examiner*—Anh T. N. Vo
(74) *Attorney, Agent, or Firm*—Reising, Ethington, Barnes, Kisselle,P.C.

(57) ABSTRACT

An ink flow control device for a printer having at least one print head includes a main body, an ink flow passage formed at least in part in the main body and constructed and arranged to communicate a supply of ink with a print head, a diaphragm carried by the main body and defining at least part of a pressure receiving chamber on one side of the diaphragm that forms part of the ink flow passage and a reference chamber on the other side of the diaphragm, a valve operably connected to the diaphragm and being moved by the diaphragm to control ink flow through the ink flow passage.

18 Claims, 2 Drawing Sheets

INK FLOW CONTROL DEVICE FOR INK JET TYPE PRINTER

REFERENCE TO RELATED APPLICATION

Applicant claims priority of Japanese patent application, Serial No. 2003-071,930, filed Mar. 17, 2003.

FIELD OF THE INVENTION

The present invention relates generally to an ink jet type printer and more particularly to an ink flow control device for ink supplied from an ink cartridge to a print head.

BACKGROUND OF THE INVENTION

An ink jet type printer includes an ink jet print head for discharging ink as ink droplets, and an ink cartridge for storing ink to be supplied to the print head. A mechanism is required between the print head and the ink cartridge to control or meter the flow of ink to the print head. The discharge of ink from the print head causes pressure pulsations that can affect ink flow from the cartridge to the print head, as can the movement and acceleration of the print head while printing. In addition, the change in print head pressure resulting from consumption of ink within the ink cartridge, among still other factors, affects the ink flow in the printer.

SUMMARY OF THE INVENTION

An ink flow control device for a printer having at least one print head includes a main body, an ink flow passage formed at least in part in the main body and constructed and arranged to communicate a supply of ink with a print head. A diaphragm carried by the main body defines at least part of a pressure receiving chamber on one side of the diaphragm that forms part of the ink flow passage and a reference chamber on the other side of the diaphragm. A valve is moved by the diaphragm to control the flow of ink to the print head.

In one presently preferred embodiment, the valve includes a valve seat with a bore defining a portion of the ink flow passage and a valve head movable relative to and selectively engageable with the valve seat to at least substantially restrict ink flow through the bore when the valve head is engaged with the valve seat. The valve head is moved relative to the valve seat by movement of the diaphragm to control ink flow through the ink flow passage.

The ink flow control device preferably momentarily suppresses abnormal pressure variation in the ink flow passage that communicates an ink cartridge with a print head so as to discharge adequate ink droplets from the print head over a wide range of operating conditions. The device may also be calibrated so that the change in head pressure resulting from consumption of ink is absorbed or attenuated to reduce or eliminate the affect on printing performance as the level or volume of ink in an ink cartridge changes. The device preferably also includes an oblong or oval filter that provides increased surface area for ink filtration. The filter preferably includes a set or seal ring having an inner ring and an outer ring connected to the inner ring. The inner and outer rings locate the filter and provide an air-tight seal.

BRIEF DESCRIPTION OF THE DRAWINGS

These and other objects, features and advantages of the present invention will be apparent from the following detailed description of the preferred embodiments and best mode, appended claims and accompanying drawings in which:

DETAILED DESCRIPTION OF THE PREFERRED EMBODIMENTS

Figure 1:
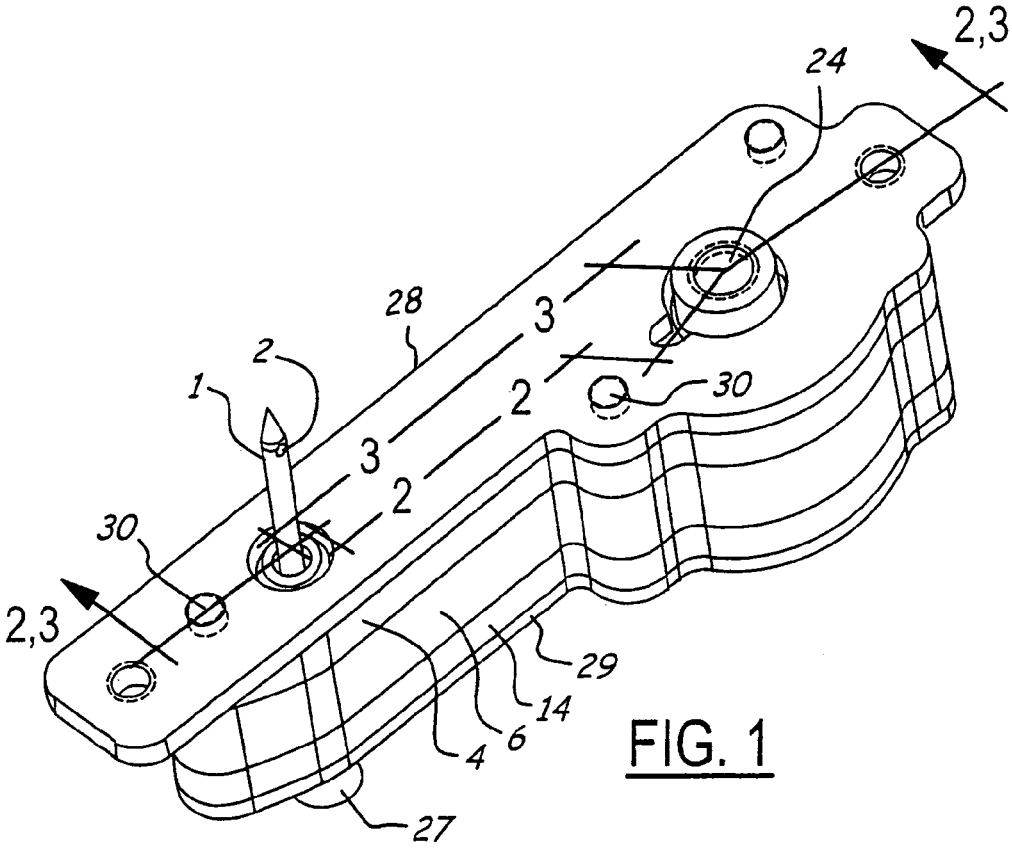
FIG. 1 is a perspective view showing an ink flow control device according to one presently preferred embodiment of the invention.
Figure 4:
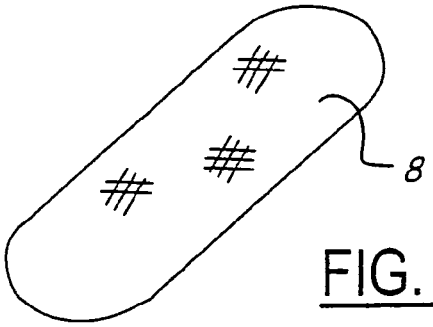
FIG. 4 is a perspective view of a filter used in the ink flow control device.
Figure 2:
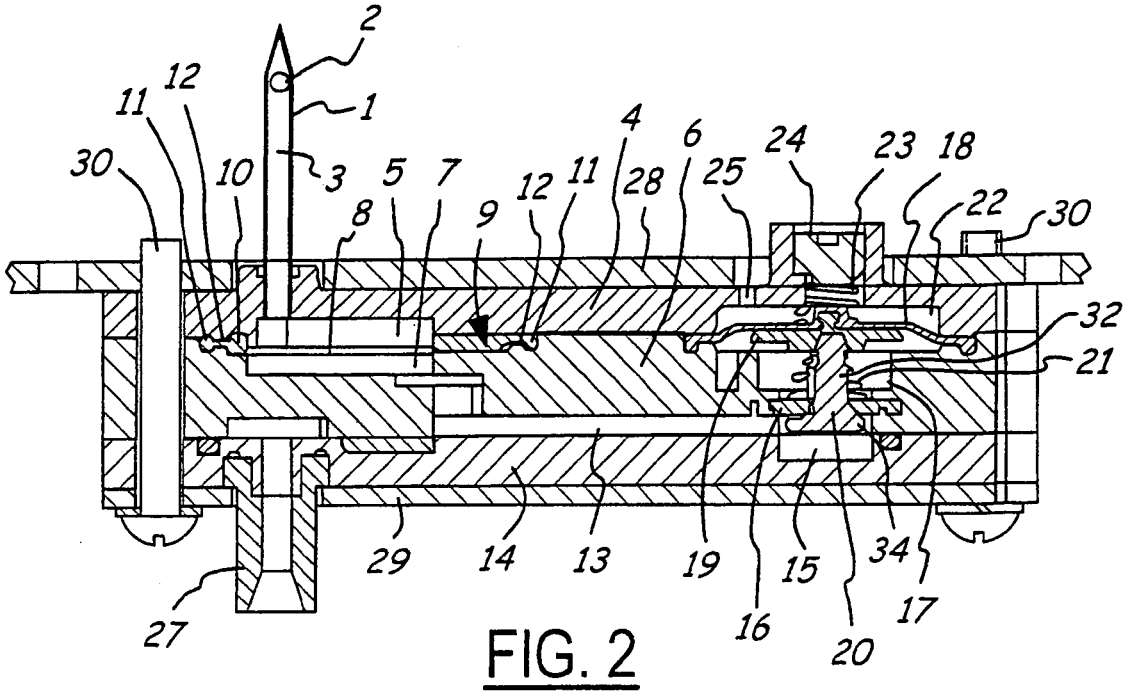
FIG. 2 is a front sectional view taken on line 2—2 of FIG. 1, showing the ink flow control device.

Referring in more detail to the drawings, FIGS. 1 and 2 illustrate one presently preferred embodiment of an ink flow control device for an ink jet type printer. The ink flow control device has a main body including a first cover plate 28, a first base plate 4, an intermediate or second base plate 6, a third base plate 14, and a second cover plate 29, preferably fastened together, such as by a plurality of screws or bolts 30. An ink supply needle 1 is positioned so that it may be inserted into an ink cartridge (not shown) and is provided with a hollow ink passage 3 having an ink inlet 2 at one end projecting toward the ink cartridge. The other end of the ink supply needle 1 is mounted on the first base plate 4, and the hollow ink passage 3 is opened to a filtration front chamber 5 provided on the base plate 4.

Figure 5:
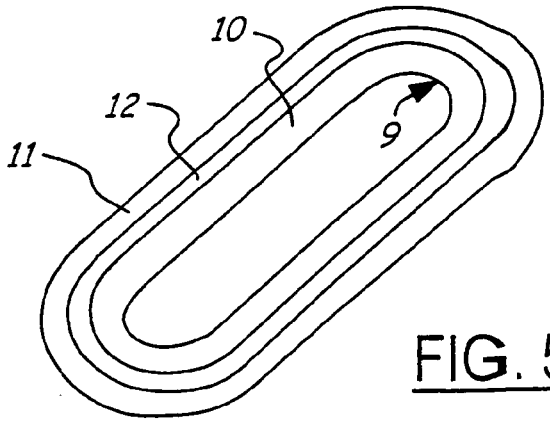
FIG. 5 is a perspective view of inner and outer set rings used in the ink flow control device.
Figure 3:
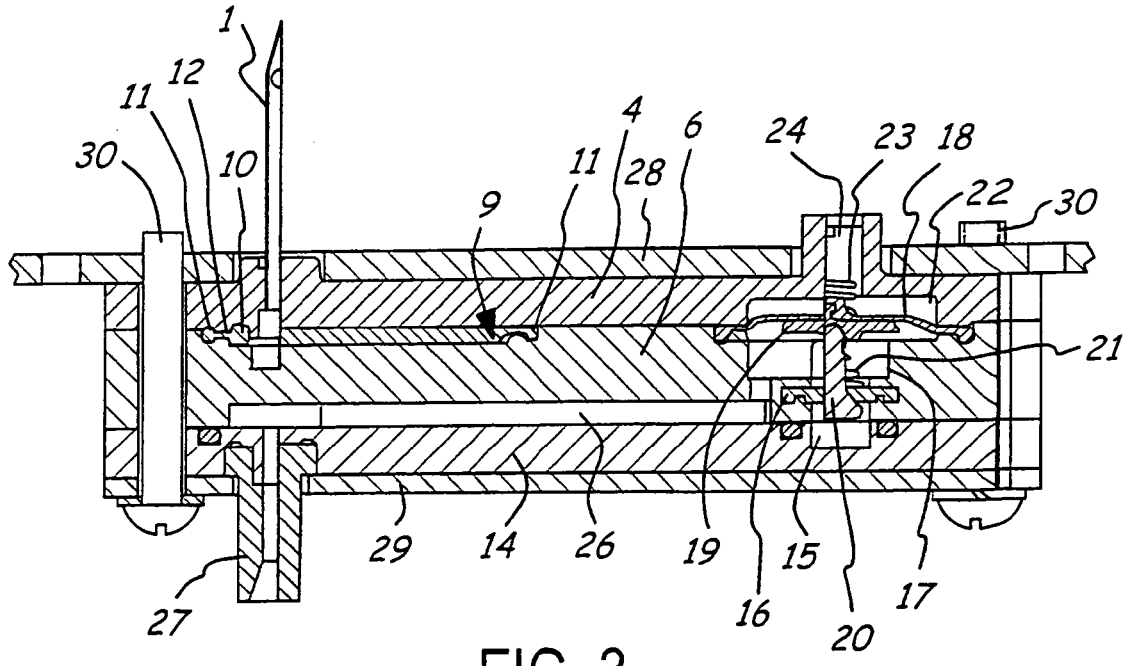
FIG. 3 is a front sectional view taken on line 3—3 of FIG. 1, showing the ink flow control device.

A filtration chamber 7 is provided opposite to the filtration front chamber 5 on the intermediate base plate 6, and a preferably generally oblong, oval or elliptical filter 8 is held between the filtration front chamber 5 and the filtration chamber 7 (between the first and second base plates 4, 6). Adjacent to the peripheral edge of elliptical filter 8, a complementarily shaped set ring 9 preferably having an inner ring 10 and an outer ring 11 is mounted between the intermediate base plate 6 and first base plate 4. As shown in FIGS. 2 and 3, the inner ring 10 preferably has in cross-section a larger diameter than does the outer ring 11. Leakage between the base plate 4 and the intermediate plate 6 is prevented by the outer ring 11 of the set ring 9. As best shown in FIG. 5, the inner ring 10 and the outer ring 11 are preferably integrally attached by a connecting piece or web 12. A passage 13 formed between the intermediate base plate 6 and the third base late 14 has one end communicating with the filtration chamber 7 and the other end communicating with a valve operating chamber 15.

The intermediate base plate 6 is provided with a valve seat 16 adjacent to the valve operating chamber 15, and a pressure receiving chamber 17 is provided opposite to the valve operating chamber 15 with the valve seat 16 therebetween. The peripheral edge of a diaphragm 18 that closes and defines in part the pressure receiving chamber 17 is received and retained between the intermediate base plate 6 and the first base plate 4 preferably providing an air tight seal between the plates 4, 6. A support plate 19 is connected to the center of the diaphragm 18, and a stem 32 of a valve body 20 of a pressure regulating valve is supported on the support plate 19. A spring 21 surrounds the stem 32 of the valve body 20 and is disposed between the support plate 19 and the valve seat 16.

In one presently preferred embodiment, the stem 32 of the pressure regulating valve 20 extends through an opening of the valve seat 16, and an enlarged valve head 34 formed on the end of the stem 32 that is selectively engageable with the valve seat 16 in the area of the opening. An atmospheric reference chamber 22 is defined in part on one side of the diaphragm 18 opposite the pressure receiving chamber 17 and communicates with the ambient environment through an atmospheric vent hole 25. A spring 23 is preferably disposed between the diaphragm 18 and the end wall of the reference chamber 22, and more preferably, between an adjustment screw 24 threadedly engaged with the first base plate 4. An ink passage 26 is formed between the intermediate base plate 6 and the third base plate 14. One end of the ink passage 26 communicates with the pressure receiving chamber 17, and the other end of the ink passage 26 is adapted to communicate with a print head through a connecting pipe or connector 27.

When the print head is not printing, the diaphragm 18 is displaced upward (as viewed in FIGS. 1 and 2) to place the valve head 34 of the pressure regulating valve 20 in contact with the valve seat 16 to close or block the opening through the valve seat 16 which defines part of the ink flow passage and prevent the valve operating chamber 15 from communicating with the pressure receiving chamber 17. When a decreased pressure or vacuum signal is provided to the pressure receiving chamber 17 such as is caused by a flow of ink when the print head is printing, the diaphragm 18 is displaced downward (as viewed in FIGS. 1 and 2), the valve head 34 of the valve body 20 is moved away from the opening of the valve seat 16, ink in the valve operating chamber 15 flows into the pressure receiving chamber 17 via the opening of the valve seat 16 and further flows to the print head via the flow passage 26 and the connecting pipe 27.

As described above in this presently preferred embodiment, the pressure receiving chamber 17, including the diaphragm 18, is provided in the ink passage and the pressure regulating valve 20 opens and closes the ink passage in response to the displacement of the diaphragm 18. Since the pressure receiving chamber 17 is provided in the ink passage, the apparatus can be made more compact in size, and since the ink passage is blocked or closed in the non-printing state and vacuum pressure caused by a flow of ink resulting from printing operation is sensed to open the ink passage only at the time of printing, the influence of acceleration caused by the displacement of the print head can be reduced or eliminated.

Since a change in head pressure interiorly of the ink cartridge resulting form consumption of ink is also absorbed in the pressure receiving chamber 17, the printing performance is not affected as the level or volume of ink in the ink cartridge changes. And since the filter 8 has an elliptical shape, the filtration area can be made large to enhance the filtration of ink.

Since in this presently preferred embodiment the filter 8 is mounted and held by the inner ring 10 of the set ring 9, and airtightness or seal is ensured by the outer ring 11, the set ring 9 performs both a filter holding function and sealing function. This facilitates assembly since both functions are accomplished by a single, unitary part.

The force for closing the pressure regulating valve is determined at least in part by the load of the spring 21. The force for opening the pressure regulating valve is determined by vacuum pressure generated at the time of the printing operation, the pressure receiving surface area of the diaphragm 18, and a combined or net force or load of the springs 21, 23 acting on the opposed surfaces of the diaphragm 18. The combined load of the springs can preferably be adjusted from outside of the device. In this presently preferred embodiment, the load of the springs can be adjusted by advancing or retracting the adjustment screw 24.

Since the loads of the pair of springs 21, 23 are exerted on opposed faces of the diaphragm 18 they tend to negate or offset each other, and the combined or net load is preferably set with the load at an intermediate position of the individual springs, with the advantage that unevenness of the combined load is lessened.

The invention claimed is:

1. An ink flow control device for a printer having at least one print head, comprising:

a main body;

an ink flow passage formed at least in part in the main body and communicating a supply of ink with a print head;

a diaphragm carried by the main body and defining at least a part of a pressure receiving chamber on one side of the diaphragm that forms part of the ink flow passage and a reference chamber on the other side of the diaphragm, a portion of the diaphragm being movable in generally opposed directions tending to increase and to decrease the volume of the pressure receiving chamber in response to a differential force across the diaphragm;

a valve including a valve seat with a bore defining a portion of the ink flow passage, a valve head movable relative to and selectively engageable with the valve seat to at least substantially restrict ink flow through the bore when the valve head is engaged with the valve seat and to permit ink flow through the bore when the valve head is not engaged with the valve seat, the valve head being moved relative to the valve seat by movement of the diaphragm to control ink flow through the ink flow passage at least in part by the movement of the diaphragm.

2. The ink flow control device of claim 1 wherein the valve includes a valve stem coupled at one end to the diaphragm, extending through the bore of the valve seat and coupled to the valve head so that the valve head and diaphragm are on opposed sides of the valve seat.

3. The ink flow control device of claim 2 which also comprises a spring disposed around the valve stem in the pressure receiving chamber to yieldably bias the diaphragm in a direction increasing the volume of the pressure receiving chamber.

4. The ink flow control device of claim 1 further comprising a spring providing a force on the diaphragm to yieldably bias the diaphragm in a first direction.

5. The ink flow control device of claim 4 wherein the spring is disposed in the pressure receiving chamber and yieldably biases the diaphragm in a direction tending to increase the volume of the pressure receiving chamber.

6. The ink flow control device of claim 3 wherein the spring is disposed in the reference chamber.

7. The ink flow control device of claim 6 which also comprises a spring disposed in the pressure receiving chamber and yieldably biasing the diaphragm with the force of the spring in the pressure receiving chamber tending to offset at least in part the force applied to the diaphragm by the spring in the reference chamber.

8. The ink flow control device of claim 6 further comprising an adjustable member carried by the main body and being movable to vary the spring force acting on the diaphragm.

9. The ink flow control device of claim 8 wherein the adjustable member is threadedly carried by the main body so that it engages one end of the spring and can be advanced and retracted to change the spring force acting on the diaphragm.

10. The ink flow control device of claim 1 which also comprises a filter carried by the main body and having an inner ring bounding the filter area and an outer ring spaced from the inner ring and connected to the inner ring by a connecting piece.

11. The ink flow control device of claim 10 wherein the main body includes a first base plate and a second base plate with the filter trapped between the first base plate and second base plate so that the outer ring provides an air-tight seal between the first base plate and second base plate.

12. The ink flow control device of claim 11 wherein the inner ring is trapped between the first base plate and the second base plate to locate the filter relative to the first base plate and second base plate.

13. The ink flow control device of claim 10 wherein the filter is oblong.

14. The ink flow control device of claim 10 wherein the filter is disposed upstream of the valve.

15. The ink flow control device of claim 1 wherein the pressure receiving chamber is disposed between the end of the ink flow passage communicated with the print head and the valve seat so that pressure changes at said end of the ink flow passage communicated with the print head are communicated to the pressure receiving chamber even if the valve head is engaged with the valve seat.

16. The ink flow control device of claim 15 wherein a decrease in pressure in the pressure receiving chamber causes the diaphragm to move in a direction reducing the volume of the pressure receiving chamber to move the valve head away from the valve seat and permit ink flow through the bore of the valve seat.

17. The ink flow control device of claim 1 which also comprises a hole in the main body communicating the reference chamber with the ambient environment.

18. An ink flow control device for a printer having at least one print head, comprising:

a main body;

an ink flow passage formed at least in part in the main body and communicating a supply of ink with a print head;

a diaphragm carried by the main body and defining at least part of a pressure receiving chamber on one side of the diaphragm that forms a part of the ink flow passage and a reference chamber on the other side of the diaphragm, a portion of the diaphragm being movable in generally opposed directions tending to increase and to decrease the volume of the pressure receiving chamber in response to a differential force across the diaphragm; and a valve controlling the flow of ink through the ink flow passage to the print head and operably connected to the diaphragm for movement by the diaphragm to permit ink flow to the print head when the print head is operating to discharge ink for printing and to at least substantially restrict ink flow when the print head is not printing in response to changes in pressure produced by operation of the print head and applied through the ink to the diaphragm.

* * * * *

UNITED STATES PATENT AND TRADEMARK OFFICE

CERTIFICATE OF CORRECTION

PATENT NO. : 7,040,742 B2
APPLICATION NO. : 10/800002
DATED : May 9, 2006
INVENTOR(S) : Teruhiko Tobinai It is certified that error appears in the above-identified patent and that said Letters Patent is hereby corrected as shown below:

Column 4
Line 15, delete “a” (first occurrence).
Line 16, after “forms” insert -- a --.

Column 4
Line 51, delete “claim 3” and insert -- claim 4 --.

Signed and Sealed this

Twenty-first Day of November, 2006

JON W. DUDAS
*Director of the United States Patent and Trademark Office*